US007389978B2

(12) United States Patent
Rowlay et al.

(10) Patent No.: US 7,389,978 B2
(45) Date of Patent: Jun. 24, 2008

(54) ADJUSTABLE CLAMP

(75) Inventors: Stephen Rowlay, Sheffield (GB); Keith M Lombardi, Avon, CT (US); Alisdair Cumming, Kingstone (GB)

(73) Assignee: The Stanley Works, New Britain, CT (US)

( * ) Notice: Subject to any disclaimer, the term of this patent is extended or adjusted under 35 U.S.C. 154(b) by 72 days.

(21) Appl. No.: 11/363,081

(22) Filed: Feb. 28, 2006

(65) Prior Publication Data

US 2007/0069437 A1 Mar. 29, 2007

(51) Int. Cl.
*B25B 1/00* (2006.01)

(52) U.S. Cl. ..... 269/6; 269/3; 269/95

(58) Field of Classification Search ..... 269/6, 269/3, 95, 166–170, 249, 246, 143
See application file for complete search history.

(56) References Cited

U.S. PATENT DOCUMENTS

| | | | |
|---|---|---|---|
| 4,220,322 | A | 9/1980 | Hobday |
| 4,524,650 | A | 6/1985 | Marks |
| 4,664,365 | A | 5/1987 | Heine |
| 4,736,927 | A | 4/1988 | Clancy |
| 4,738,438 | A | 4/1988 | Horie et al. |
| 4,739,838 | A | 4/1988 | Marks |
| 4,770,401 | A | 9/1988 | Donaldson |
| 4,926,722 | A | 5/1990 | Sorensen et al. |
| 5,005,449 | A | 4/1991 | Sorensen et al. |
| 5,009,134 | A | 4/1991 | Sorensen et al. |
| 5,022,137 | A | 6/1991 | Sorensen et al. |
| D320,919 | S | 10/1991 | Sorensen |
| 5,094,131 | A | 3/1992 | Sorensen et al. |
| 5,110,100 | A | 5/1992 | Cotton |
| D328,846 | S | 8/1992 | Sorensen et al. |
| 5,161,787 | A | 11/1992 | Hobday |
| 5,170,682 | A | 12/1992 | Sorensen et al. |
| 5,222,420 | A | 6/1993 | Sorensen et al. |
| D340,851 | S | 11/1993 | Sorensen |
| D341,069 | S | 11/1993 | Sorensen |
| 5,265,854 | A | 11/1993 | Whiteford |
| D357,165 | S | 4/1995 | Sorensen et al. |
| 5,443,246 | A | 8/1995 | Peterson |
| 5,584,458 | A | 12/1996 | Rando |
| 5,593,147 | A | 1/1997 | Read |

(Continued)

FOREIGN PATENT DOCUMENTS

| | | |
|---|---|---|
| WO | WO 02/14020 | 2/2002 |

(Continued)

*Primary Examiner*—Lee D Wilson
(74) *Attorney, Agent, or Firm*—Pillsbury Winthrop Shaw Pittman, LLP

(57) ABSTRACT

A jaw for a bar clamp and a method of using a bar clamp, the bar clamp including a trigger having a first force applying mechanism to apply a first force against the drive lever at a first point on the drive lever that is remote from the bar as the trigger pivots with respect to the main section to provide low mechanical advantage to the drive lever. The trigger also having a second force applying mechanism to apply a second force against the drive lever at a second point on the drive lever that is closer to the bar than the first point as the trigger pivots with respect to the main section to provide high mechanical advantage to the drive lever.

20 Claims, 12 Drawing Sheets

U.S. PATENT DOCUMENTS

| | | | | |
|---|---|---|---|---|
| 5,664,817 | A | 9/1997 | Ballew et al. | |
| 5,666,964 | A | 9/1997 | Meilus | |
| 5,853,168 | A | 12/1998 | Drake | |
| 5,988,616 | A | 11/1999 | Fuller et al. | |
| D417,377 | S | 12/1999 | Blank et al. | |
| 6,029,964 | A | 2/2000 | Bohl | |
| 6,050,559 | A | 4/2000 | de Souza | |
| 6,089,556 | A | 7/2000 | Whiteford | |
| 6,254,073 | B1 | 7/2001 | Noniewicz et al. | |
| 6,302,386 | B1 | 10/2001 | Fuller et al. | |
| 6,338,475 | B1 | 1/2002 | Ping | |
| 6,340,154 | B1 | 1/2002 | Young | |
| 6,347,791 | B1 | 2/2002 | Chervenak | |
| 6,367,787 | B1 | 4/2002 | Poole et al. | |
| 6,382,608 | B1 | 5/2002 | Michell | |
| 6,386,530 | B1 | 5/2002 | Marks | |
| 6,412,767 | B1 | 7/2002 | Beck et al. | |
| 6,438,854 | B1 | 8/2002 | Kott, Jr. | |
| 6,450,489 | B1 | 9/2002 | Wang | |
| 6,474,632 | B1 | 11/2002 | Liou | |
| 6,578,837 | B1 | 6/2003 | Blank et al. | |
| 6,585,243 | B1 | 7/2003 | Li | |
| 6,641,122 | B2 | 11/2003 | Roesch | |
| 6,648,314 | B1 | 11/2003 | Degen et al. | |
| 6,648,315 | B1 | 11/2003 | Lee | |
| 6,655,670 | B1 | 12/2003 | Liou | |
| 6,676,120 | B1 | 1/2004 | Hallbeck et al. | |
| 6,685,176 | B2 | 2/2004 | Wirth, Jr. et al. | |
| D488,043 | S | 4/2004 | Ben-Gigi | |
| 6,758,098 | B1 | 7/2004 | Nunnelee | |
| D494,828 | S | 8/2004 | Phillips | |
| D500,238 | S | 12/2004 | Varzino | |
| 6,883,795 | B2 | 4/2005 | McCormick et al. | |
| 6,957,808 | B2 | 10/2005 | Varzino et al. | |
| 6,971,641 | B1 | 12/2005 | Sherwin | |
| 7,066,457 | B2 | 6/2006 | Gerritsen et al. | |
| 7,090,209 | B1 * | 8/2006 | Rowlay | 269/6 |
| 2003/0075850 | A1 | 4/2003 | Wirth, Jr. et al. | |
| 2003/0090048 | A1 | 5/2003 | Varzino et al. | |
| 2003/0141644 | A1 | 7/2003 | Thomas | |
| 2004/0113344 | A1 | 6/2004 | Wirth, Jr. et al. | |
| 2004/0140602 | A1 * | 7/2004 | Gerritsen et al. | 269/6 |
| 2004/0195746 | A1 * | 10/2004 | Marks | 269/6 |
| 2005/0082728 | A1 | 4/2005 | Cicenas et al. | |
| 2005/0121842 | A1 | 6/2005 | Lo | |
| 2006/0091596 | A1 | 5/2006 | Marusiak | |
| 2007/0069438 | A1 * | 3/2007 | Rowlay et al. | 269/6 |

FOREIGN PATENT DOCUMENTS

| | | |
|---|---|---|
| WO | WO 2005/011918 A2 | 2/2005 |

* cited by examiner

ADJUSTABLE CLAMP

The subject application is a continuation-in-part application of and claims priority to U.S. patent application Ser. No. 11/236,566, filed on Sep. 28, 2005, and now pending, such application being hereby incorporated herein in its entirety by reference thereto.

FIELD OF THE INVENTION

The present invention relates to an adjustable clamp and to a method of using an adjustable clamp. More specifically, the present application illustrates embodiments of the present invention, including those relating to an adjustable clamp with a fixed jaw.

BACKGROUND

Known adjustable clamps include one moving jaw and one fixed jaw. U.S. Pat. No. 6,386,530 to Marks, U.S. Pat. No. 6,474,632 to Liou, U.S. Pat. No. 5,005,449 to Sorensen, U.S. Pat. No. 5,443,246 to Peterson, U.S. Pat. No. 5,265,854 to Whiteford, U.S. Pat. No. 5,853,168 to Drake, and U.S. Pat. No. 5,666,964 to Meilus, and U.S. Patent Application Publication Nos. 2003/0090048 to Verzino et al.; and 2004/0140602 to Gerritsen et al., which disclose various clamps, are each incorporated herein in its entirety by reference thereto, respectively.

SUMMARY OF THE INVENTION

One aspect of the invention relates to a jaw for a bar clamp, including: a main section structured and arranged to permit a bar to pass-through; a clamping face extending from said main section; a drive lever structured and arranged to couple the bar; a handle extending from said main section; and a trigger pivoted to said main section, said trigger having a first force applying mechanism structured and arranged to apply a first force against said drive lever at a first point on said drive lever that is remote from the bar as said trigger pivots with respect to said main section to provide low mechanical advantage to said drive lever, said trigger having a second force applying mechanism structured and arranged to apply a second force against said drive lever at a second point on said drive lever that is closer to the bar than said first point as said trigger pivots with respect to said main section to provide high mechanical advantage to said drive lever, said first force applying mechanism structured and arranged to apply said first force against said drive lever while said second force applying mechanism applies said second force against said drive lever.

Another aspect of the invention relates to a jaw for a bar clamp, comprising: a main section structured and arranged to permit a bar to pass-through; a clamping face extending from said main section; a drive lever structured and arranged to couple the bar; a handle extending from said main section; and a trigger pivoted to said main section, said trigger having a resilient member coupled to said drive lever to apply a first force against said drive lever at a first point on said drive lever that is remote from the bar as said trigger pivots with respect to said main section to provide low mechanical advantage to said drive lever, said trigger having a second force applying mechanism structured and arranged to apply a second force against said drive lever at a second point on said drive lever that is closer to the bar than said first point as said trigger pivots with respect to said main section to provide high mechanical advantage to said drive lever, said resilient member being structured and arranged to apply said first force against said drive lever in an extended position, and to apply said first force against said drive lever in a contracted position while said second force applying mechanism applies said second force against said drive lever.

Another aspect of the invention relates to a jaw for a bar clamp, including a main section structured and arranged to permit a bar to pass-through; a clamping face extending from said main section; a drive lever structured and arranged to couple the bar; a handle extending from said main section; and a trigger pivoted to said main section, said trigger including means for applying a first force against the drive lever to provide low mechanical advantage to the drive lever while pulling the trigger, and means for applying a second force against the drive lever to provide high mechanical advantage to the drive lever while pulling the trigger.

Still another aspect of the invention relates to a method of using a bar clamp, including: positioning a first jaw on a first bar clamp, the first jaw being selectively securable on the first bar; positioning a second jaw with a mechanical motor unit on the first bar, the second jaw having a main section structured and arranged to permit the first bar to move the first jaw relative to the second jaw, a clamping face extending from the main section, a drive lever that couples the first bar, a handle extending from the main section, and a trigger pivoted to the main section; and activating the mechanical motor unit to move the first bar and to force the first jaw toward the second jaw, the activating of the mechanical motor unit occurring by pulling the trigger towards the handle to apply a first force against the drive lever at a first point on the drive lever that is remote from the bar as the trigger pivots with respect to the main section to provide low mechanical advantage to the drive lever, and further pulling the trigger toward the handle to apply a second force against the drive lever at a second point on the drive lever that is closer to the bar than the first contact point as the trigger pivots with respect to the main section to provide high mechanical advantage to the drive lever, and the first force being applied against the drive lever while the second force is applied against the drive lever.

Other aspects, features, and advantages of this invention will become apparent from the following detailed description when taken in conjunction with the accompanying drawings, which are a part of this disclosure and which illustrate, by way of example, the principles of this invention.

BRIEF DESCRIPTION OF THE DRAWINGS

The accompanying drawings facilitate an understanding of the various embodiments of this invention. In such drawings.

DESCRIPTION OF ILLUSTRATED EMBODIMENTS

Figure 1:
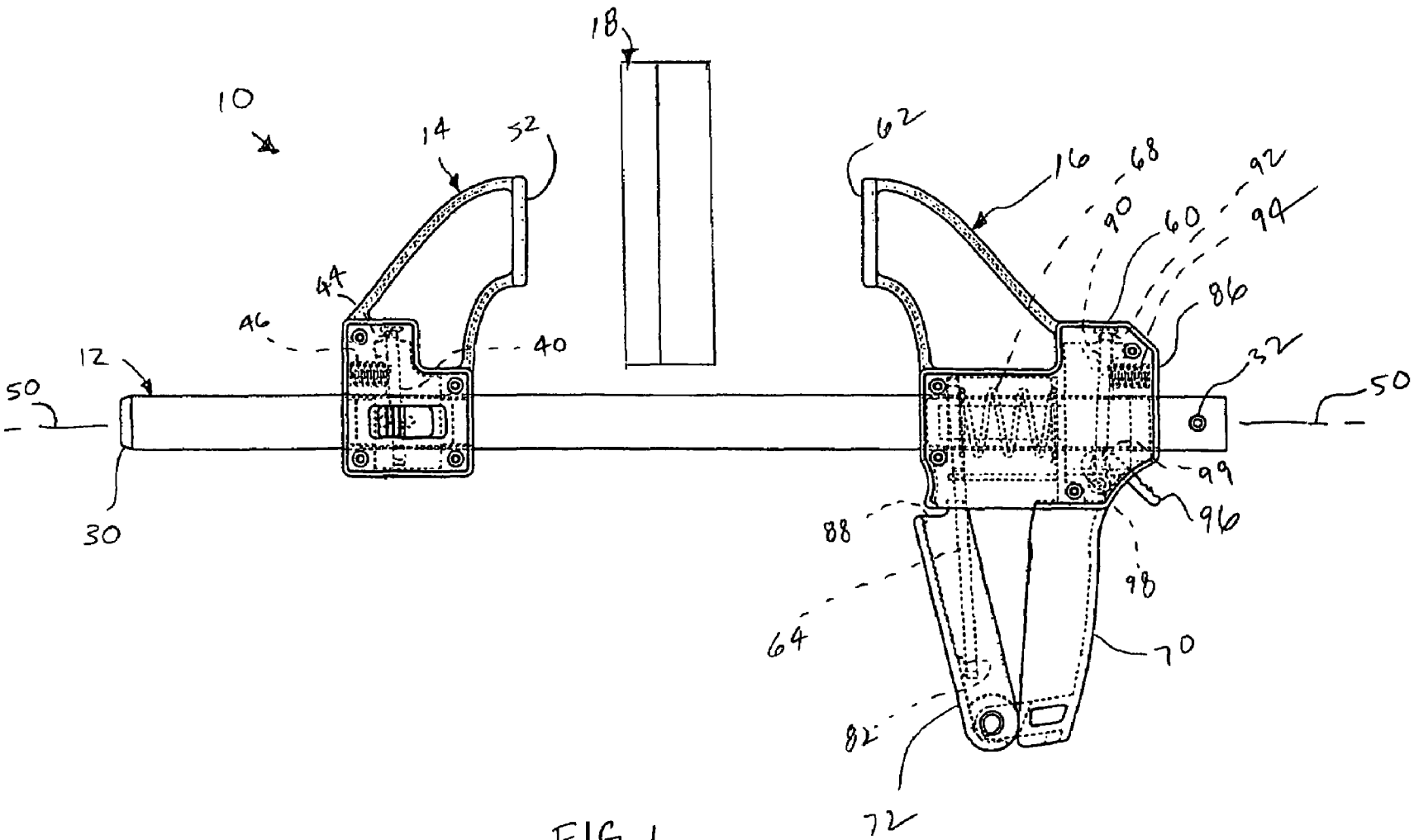
FIG. 1 illustrates a side view of an adjustable clamp, in accordance with one illustrated embodiment of the present invention.

One embodiment of the invention is illustrated in FIGS. 1-5, which illustrate an adjustable clamp 10 having a bar 12, a moving jaw 14, and a fixed jaw 16. In one embodiment, clamp 10 may be used by positioning jaws 14 and 16 on opposite sides of a member 18 to be clamped. The fixed jaw 16 is then activated to pull the bar 12 through the fixed jaw 16, thus bringing moving jaw 14 closer to fixed jaw 16. The fixed jaw 16 may be selectively activated so that the fixed jaw may move the bar 12 rapidly and easily through the fixed jaw 16 prior to the clamping of the member 18 and then, once the clamping on member 18 beings, the activation of fixed jaw 16 may advance the bar 12 through the fixed jaw 16 at a slower rate but with a higher mechanical advantage so that greater force can be applied in the easiest manner for the user applying the pressure to the fixed jaw 16 by hand.

Bar 12 is preferably a solid bar formed of sufficiently rigid material, such as metal or plastic. The bar 12 may have an inserting end 30 and a stop 32 to permit the jaws 14 and 16 to be inserted on the bar and removed from the same end, that is, via the inserting end 30. Alternatively, as discussed with other embodiments, the bar 12 may be formed without a stop 32 and the jaws 14 and 16 may be placed on and taken off the bar 12 at either end.

Although the moving jaw 14 may be any of the various moving-type jaws known in the prior art, moving jaw 14 is illustrated as having a braking lever 40 that permits the bar 12 to pass through moving jaw housing 42. The braking lever 40 is pivoted within the moving jaw housing 42 within a groove 44 and is biased by a resilient element, such as a spring 46. The spring 46 biases the braking lever 40 against the bar 12 to lock the housing 42 and the moving jaw 14 in a selected position on the bar 12. When it is desired to move the moving jaw 14 along the bar 12, a slide release button 48 is slid along a track to move the braking lever 40 from an inclined orientation with respect to the longitudinal axis 50 of the bar 12 to a more perpendicular orientation with respect to the longitudinal axis 50 of bar 12, thus freeing the braking lever 40 from the bar 12 and permitting the moving jaw 14 to move along the bar 12. Preferably, the moving jaw 14 would be moved to a selected position on the bar 12 and then clamped against member 18 upon activation of the fixed jaw 16. The moving jaw has a clamping face 52 for engaging member 18.

Member 18 is any member or members needed clamping. For example, member 18 may be two elements that are being joined together by adhesive and require a clamping force to ensure a tight connection while the adhesive cures.

Fixed jaw 16, as illustrated in the figures, has a main section that is structured and arranged to permit the bar 12 to pass therethrough. As illustrated, the main section comprises a housing 60 having an opening extending completely therethrough for the passage of bar 12. The fixed jaw 16 also has a clamping face 62 extending from the housing 60. A drive lever 64 is positioned within the housing 60 and is structured and arranged to couple the bar 12. That is, the illustrated drive lever 64 has an opening 66 extending therethrough for the passage of bar 12. The drive lever 64 is movable within the housing 60 and may be maintained within its area of movement within the housing 60 by housing 60 itself. Drive lever 64 is biased by a resilient element, such as a spring 68 in a direction away from handle 70, which extends from housing 60 for grasping by a user. The handle has a lug 71 to which a trigger 72 is pivoted to the handle 70. The trigger 72 may pivot about a pin 74 extending through lug 71. The trigger 72 pivots at a position on the handle 70 that is the furthestmost position on the handle 70 from the bar 12. As illustrated in the figures, trigger 72 is pivoted to the bottommost section of the handle 70. The upper section 76 of the trigger 72 is free to move within the housing 60 and is maintained by the outer limits of housing 60 from pivoting outside the housing 60.

The trigger 72 is hollow with three sides and trigger 72 is open in the side facing handle 70. The inner contact surface 80 is the interior side of the trigger 72 that is most remote from the handle 70 and adjacent to the drive lever 64. The inner contact surface 80 provides the points of contact of the trigger 72 with the drive lever 64. As evident herein, as the trigger 72 is pulled toward the handle 70 the contact point with the drive lever changes position.

Figure 2:
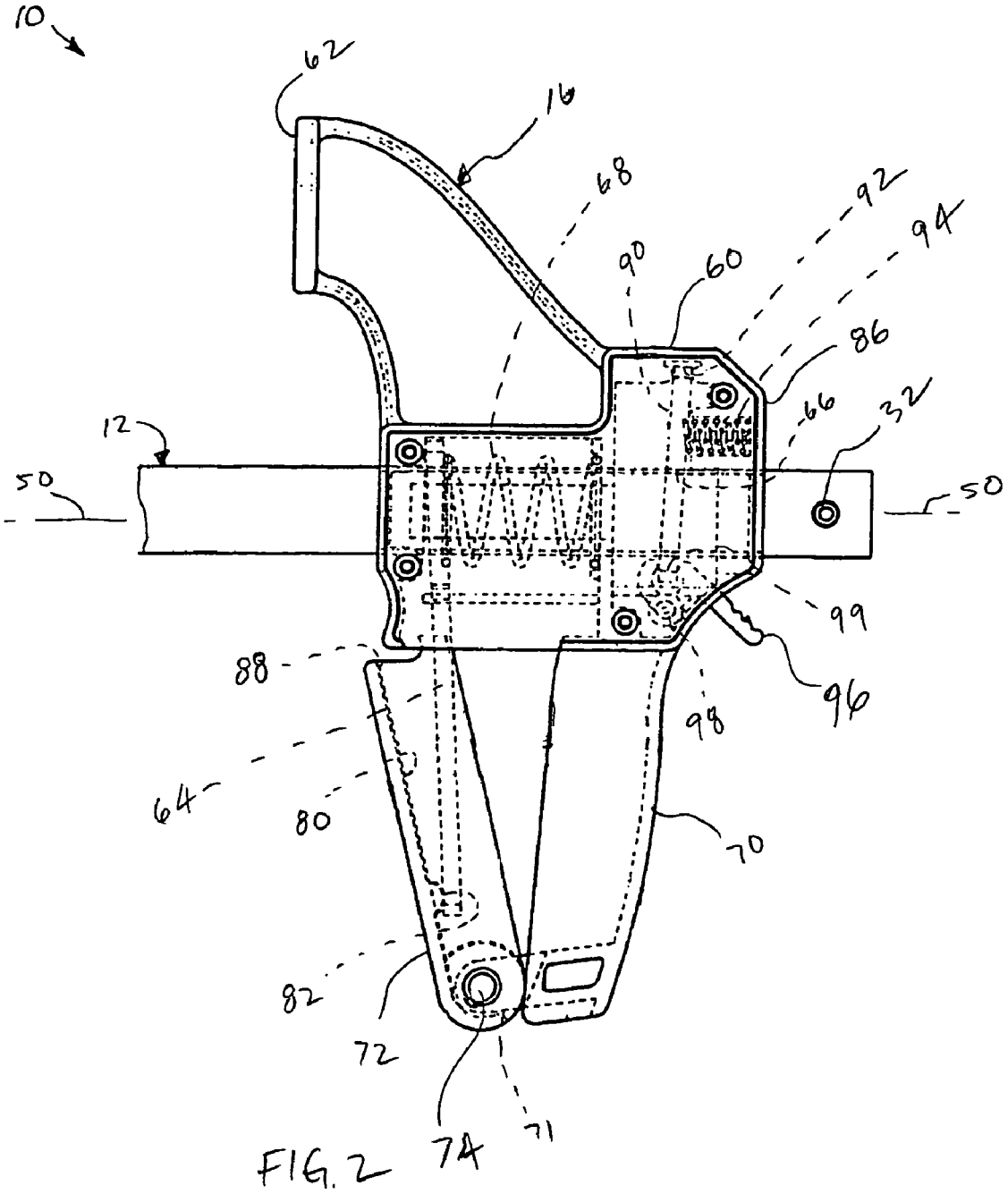
FIG. 2 illustrates an enlarged, side view of the fixed jaw of the clamp of FIG. 1.
Figure 3:
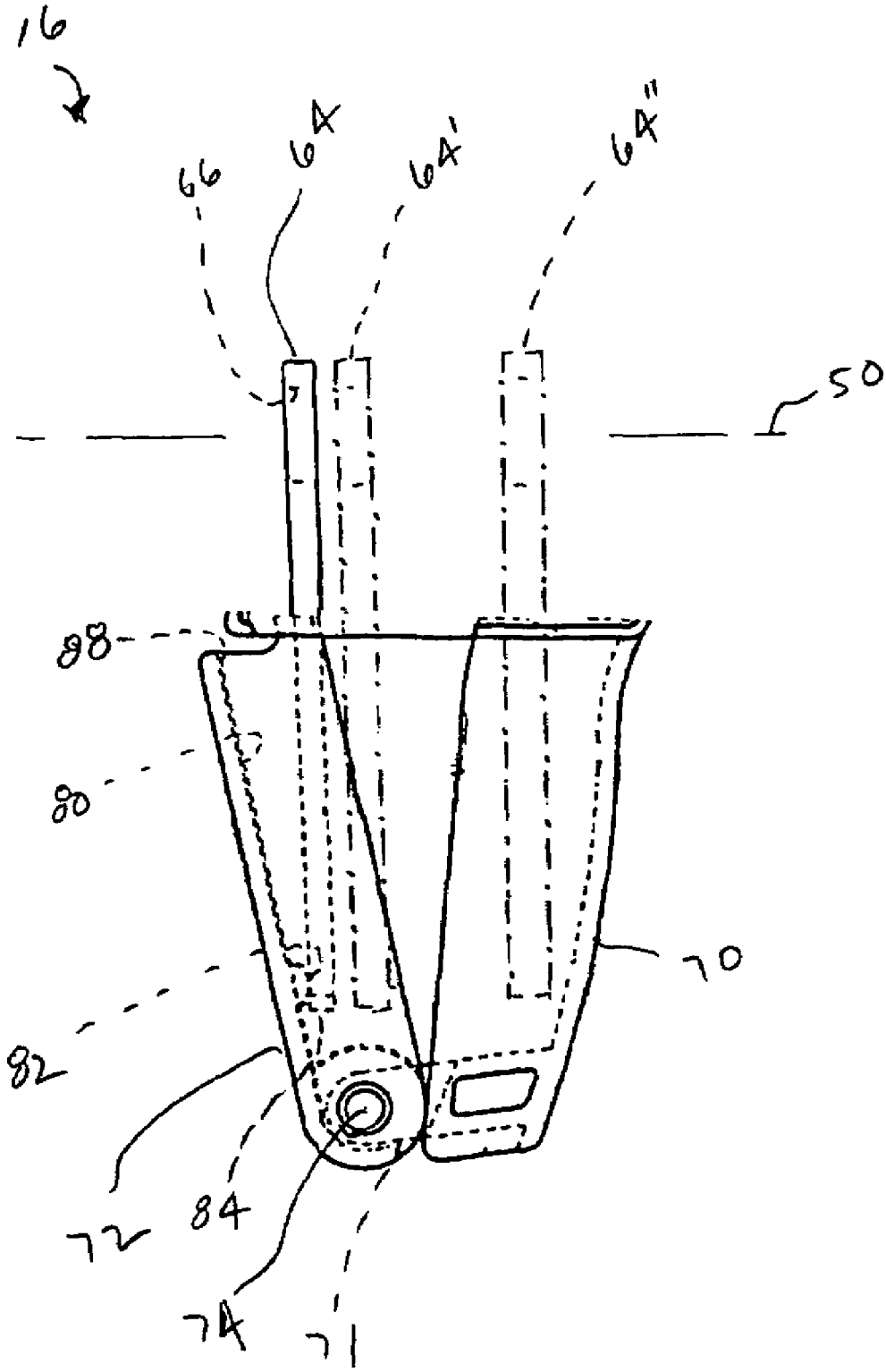
FIGS. 3-5 illustrate partial, views of the fixed jaw illustrated in FIG. 2 but showing the trigger and the drive lever in different positions with respect to the handle during activation of the trigger.

The trigger is shown in the nonactuated position in FIGS. 1-3. When the trigger 72 is in the nonactuated position, the trigger 72 is biased to pivot away from the handle 70 by the force of the drive lever 64 via the biasing of spring 68. In this nonactuated position, the trigger 72 has an initial contact point 82 on the contact surface 80 that is in contact with the drive lever 64. The initial contact point 82 may be in the form of a projection 82, as illustrated.

FIGS. 2-5 illustrate the pivoting of trigger 72 and the changing of the contact point between the trigger 72 and the drive lever 64. In FIGS. 2 and 3, the trigger 72 is in the nonactuated position as biased by spring 68. The trigger 72 contacts the driving lever 64 at initial contact point 82, which is at the remote end 84 of drive lever 64, which is the furthest extent of the drive lever 64 from the bar 12. As seen in the figures, the contact point 82 is at the bottom of the drive lever 64. Therefore, when the trigger 72 initially is pulled by a hand of the user and pivots about pin 74 toward the handle 70 out of the nonactuated position, the contact point 84 with the drive lever 64 is such that a high mechanical advantage is produced for forcing the drive lever 64 to move the bar 12 toward the rear end 86 of housing 60. This is because the force applied by the user on the trigger 72 is directed against the drive lever 64 at the furthest point on the drive lever 64 from the connection between the drive lever 64 and bar 12. Since the size of the opening 66 in drive lever 64 is slightly larger than the width of the bar 12, when the angle of bar 12 is inclined with respect to a line parallel to the longitudinal axis 50 of the bar 12, as shown in FIGS. 1-5, a tight, slip-free fit is created between the bar 12 and the drive lever 64 so that when the drive lever 64 is moved, the bar 12 moves along with the drive lever 64.

Figure 4:
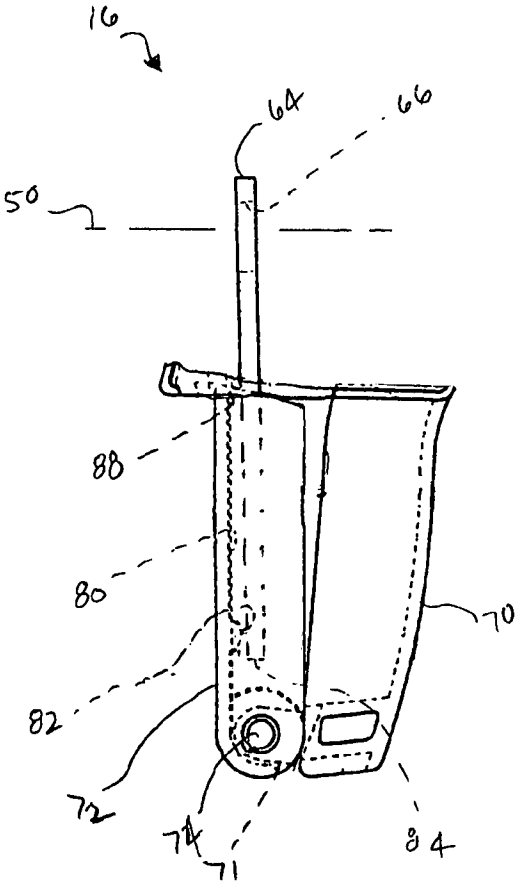

As seen in FIG. 4, as the trigger 72 is pivoted toward handle 70, the contact point 84 between the trigger 72 and the drive lever 64 does not necessarily change, but the pivoting of the handle 70 moves the protrusion that forms the contact point 84 closer toward the handle 70 and, thus, forces movement to the drive lever 64 toward the rear 86 of housing 60 while continuing to provide a high mechanical advantage since the contact point between the trigger 72 and the drive lever 64 remains at the remote end 84 of the drive lever 64. FIG. 3 shows the positional movement change of the drive lever 64 from the nonactuated position of FIG. 2 (shown with drive lever 64 in solid lines) to the position of FIG. 4 (shown with the drive lever 64' (primed) in dashed lines).

Figure 5:
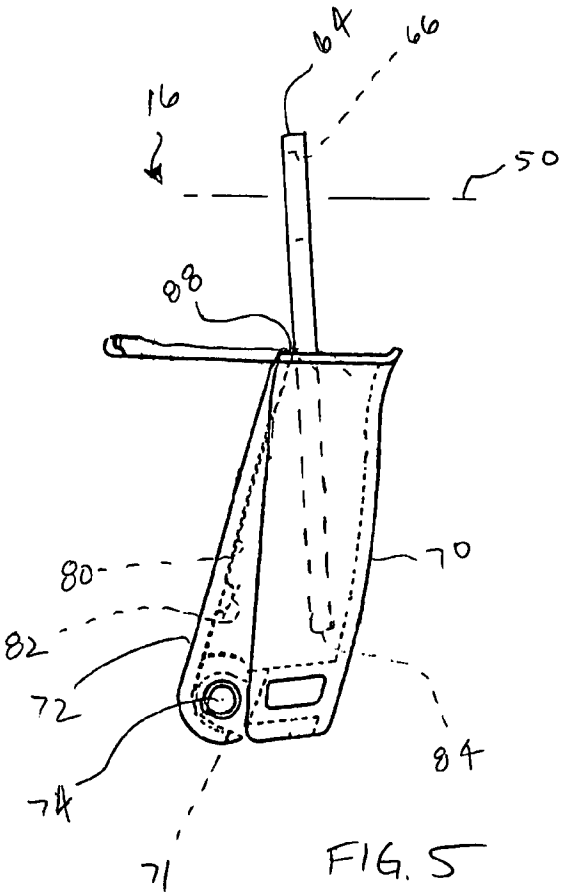

As the trigger 72 is pulled further, as seen in FIG. 5, the trigger 72 pivots further about pin 74 and the contact point between the trigger 72 and the drive lever 64 shifts from the initial contact point 82 to the final contact point 88, which is substantially closer to the bar 12. Thus, the mechanical advantage is reduced to a low mechanical advantage. This is because the force applied by the user to the trigger 72 is now being applied at contact point 88, which is very close to the bar 12. However, since the trigger 72 is pivoted at the end of handle 70 that is remote from the bar 12, the final contact point 88 moves a great distance compared to the movement of the initial contact point 82. Therefore, although the mechanical advantage shown in FIG. 5 using final contact point 88 is low, the amount that the bar 12 travels to toward the rear 86 of the housing 60 increases. FIG. 3 shows the positional movement change of the drive lever 64 from the position of FIG. 4 (shown with drive lever 64' (prime) in dashed lines) to the position of FIG. 5 (shown with the drive lever 64" (double prime) in dashed lines).

Therefore, if, for example, the fixed jaw 16 is not in contact with the member 18 a user can quickly and easily pull the trigger 72 to its fullest extent and rapidly repeat the full trigger pulls to quickly and easily move the bar 12 toward the rear 86 of housing 60 since the final contact point 82 is employed. Then, when, for example, the jaws 14 and 16 are in contact with the member 18 and it is desired to clamp the member 16 with a large force requiring little movement of the bar 12, the initial contact point 82 will be employed since only slight movement of the bar 12 by the drive lever 64 will be possible and a high mechanical advantage will be produced making it relatively easier for the use to apply a higher clamping force against the bar 12 and the member 18.

Although, the illustrated embodiment only shows two contact points 82 and 88, the contact surface 80 of trigger 72 may be designed so that there are any number of contact points. For example, the contact surface 80 could provide an entirely gradual change of position for the contact point between the trigger 72 and the drive lever 64. Thus, the contact point could gradually move up the drive lever 64 as the trigger 72 is pulled toward the housing 60.

When it is desired to release the clamping force and the bar 12, fixed jaw 16 also has a breaking lever 90 that permits the bar 12 to pass therethrough. The braking lever 90 is pivoted within the housing 60 within a groove 92 and is biased by a resilient element, such as a spring 94. The spring 94 biases the braking lever 90 against the bar 12 to lock the housing 60 and the fixed jaw 16 in a selected position on the bar 12. So that when the trigger 72 is pulled and the bar 12 moves toward the rear 86 of housing 60, the breaking lever 90 is biased by spring 94 to permit movement in that direction but to prohibit movement in the opposite direction. The principles of locking are similar to those of the breaking lever 90 of the moving jaw 14 and of the drive lever 64 of the fixed jaw 16. When it is desired to move the bar 12 through the fixed jaw 16 toward the clamping face 62, a release button 96 is used to move the bottom of breaking lever 90 toward the rear 86 of housing 60 and release the bar 12 to move in the forward direction. The release button 96 is pivoted to the housing at pivot and has a mid-portion 99 that captures the bottom of braking lever 90 to move the lever 90 when the release button 96 is pivoted.

Figure 6:
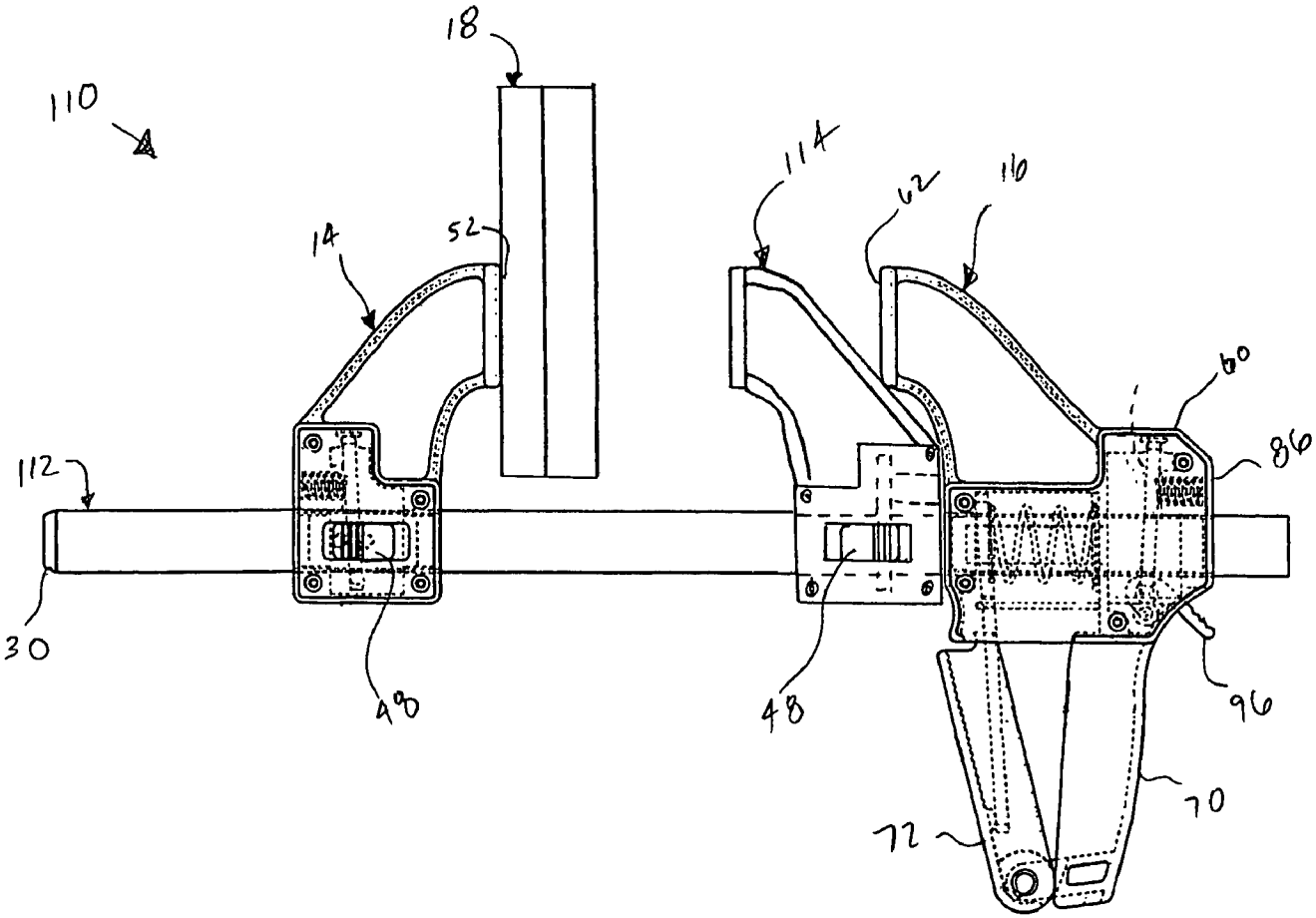
FIG. 6 illustrates an adjustable clamp in accordance with another illustrated embodiment of the present invention.
Figure 7:
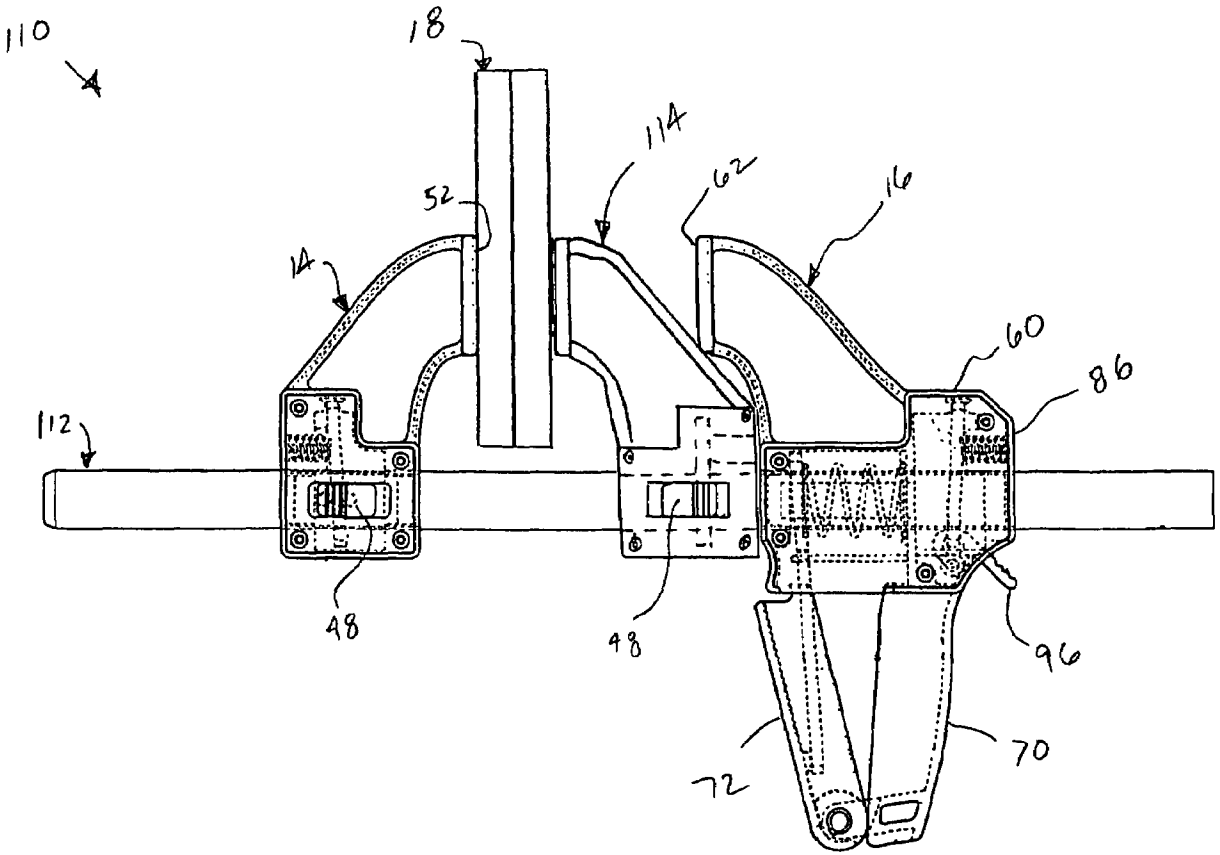
FIG. 7 illustrates the clamp of FIG. 6 clamping the member to be clamped.
Figure 8:
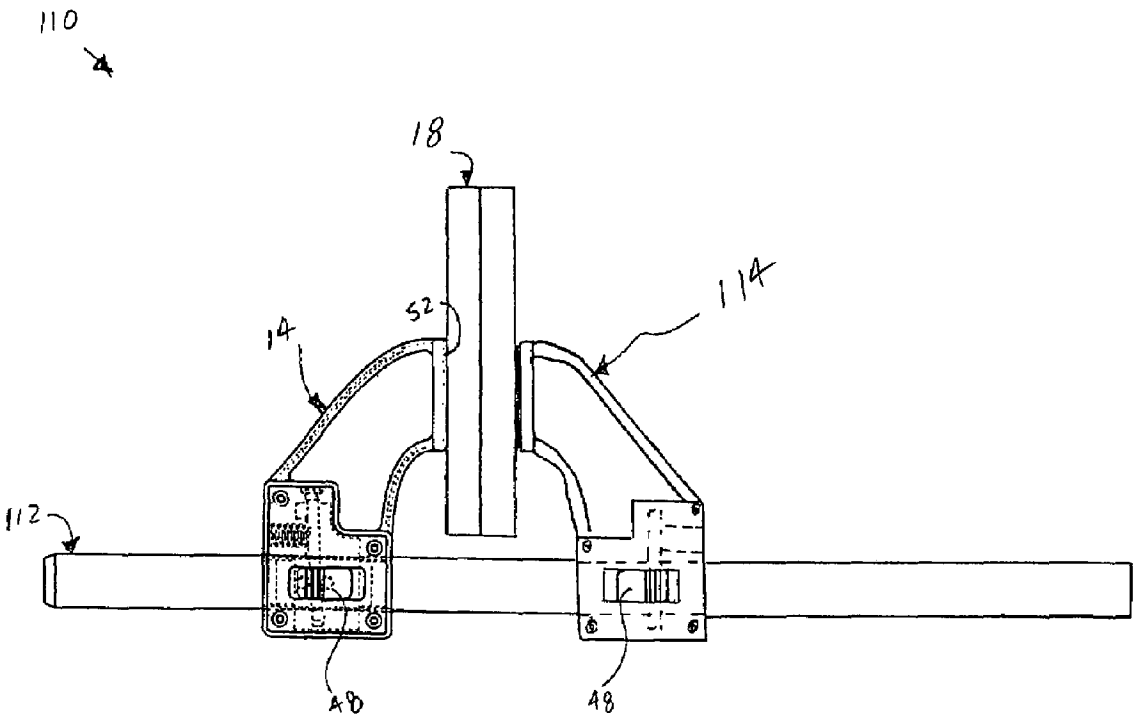
FIG. 8 illustrates the clamp of FIG. 8 with the motor unit removed after the member is clamped.

FIGS. 6-8 show another embodiment of the invention, wherein two moving jaws 14 and 114 are used to clamp member 18. FIG. 6 shows an adjustable clamp 110 having a bar 112, a first moving jaw 14, a second moving jaw 114, and a fixed jaw 16. Clamp 110 is substantially identical to clamp 10 described above, except for the inclusion of a second moving jaw 114. Also, moving jaw 114 is substantially identical to moving jaw 14, except that moving jaw 114 is oriented in an opposite direction and, thus, may move freely toward moving jaw 14, but it will only move away from moving jaw 14 if the release button 48 is used. Bar 112 is substantially identical to bar 12 except that bar 112 does not have a stop 32.

As can be seen in FIG. 6, the moving jaw 114 is positioned between the fixed jaw 16 and the moving jaw 14 so that when the fixed jaw 16 is actuated to pull the bar 112 through fixed jaw 16 toward the rear 86 of housing 60, the moving jaw 14 will clamp the member 18 along with second moving jaw 114 instead of fixed jaw 16 as seen in FIG. 7. Then, once the first and second moving jaws 14 and 114 clamp member 18, the fixed jaw 16 can be removed from the bar 112 while the clamp on member 18 is maintained and be used in other adjustable clamps, such as in clamps similar to clamp 10 or in clamps similar to clamp 110. Fixed jaw 16 can be removed from bar 12 by pushing the release button 96 and pulling the fixed jaw 16 away from the moving jaw 114 and off the bar 12. When it is desired to release the clamping of member 18, the release buttons 48 are activated.

Figure 9:
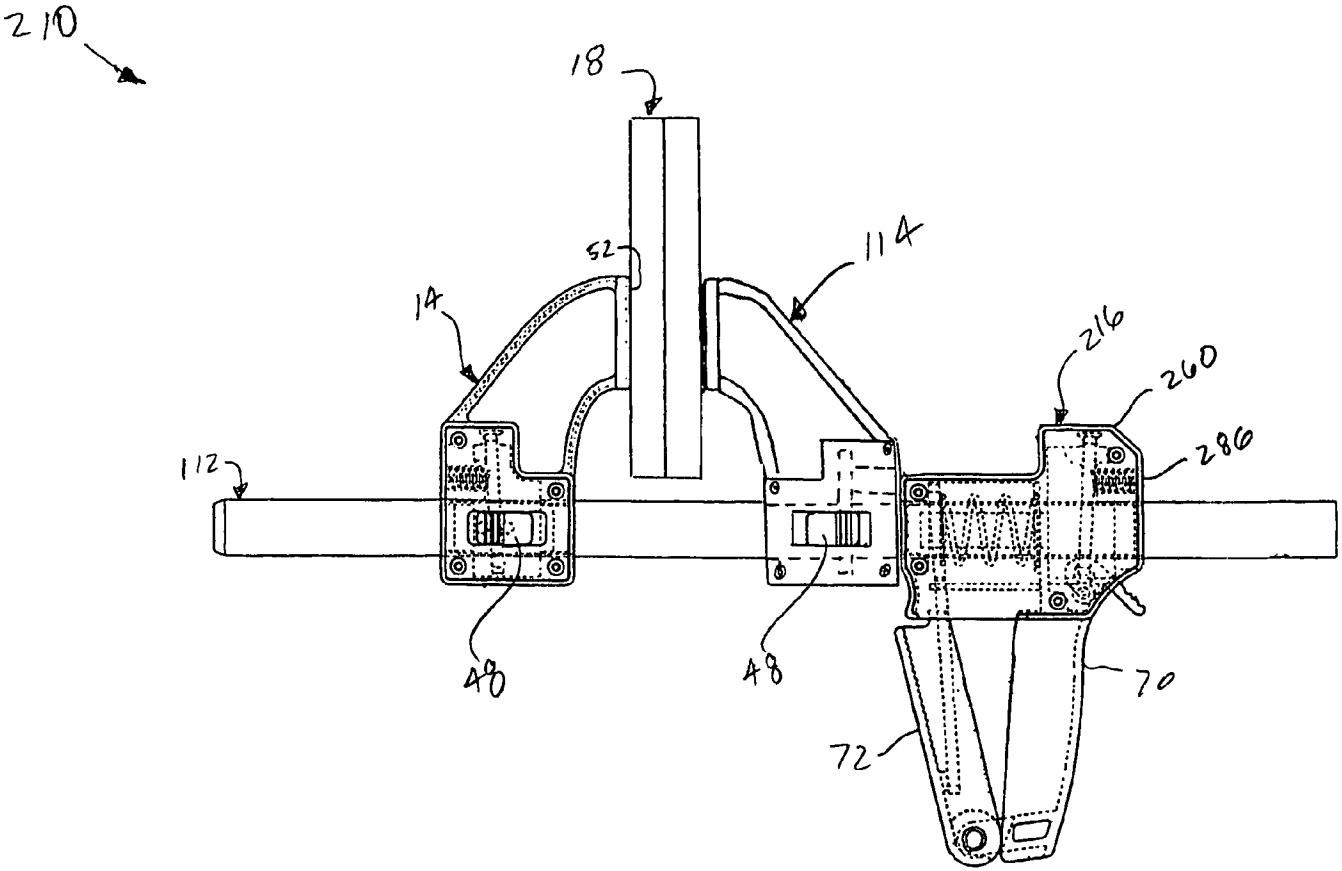
FIG. 9 illustrates an adjustable clamp similar to that shown in FIG. 7, but with motor unit without a clamping surface, in accordance with yet another embodiment of the invention.
Figure 10:
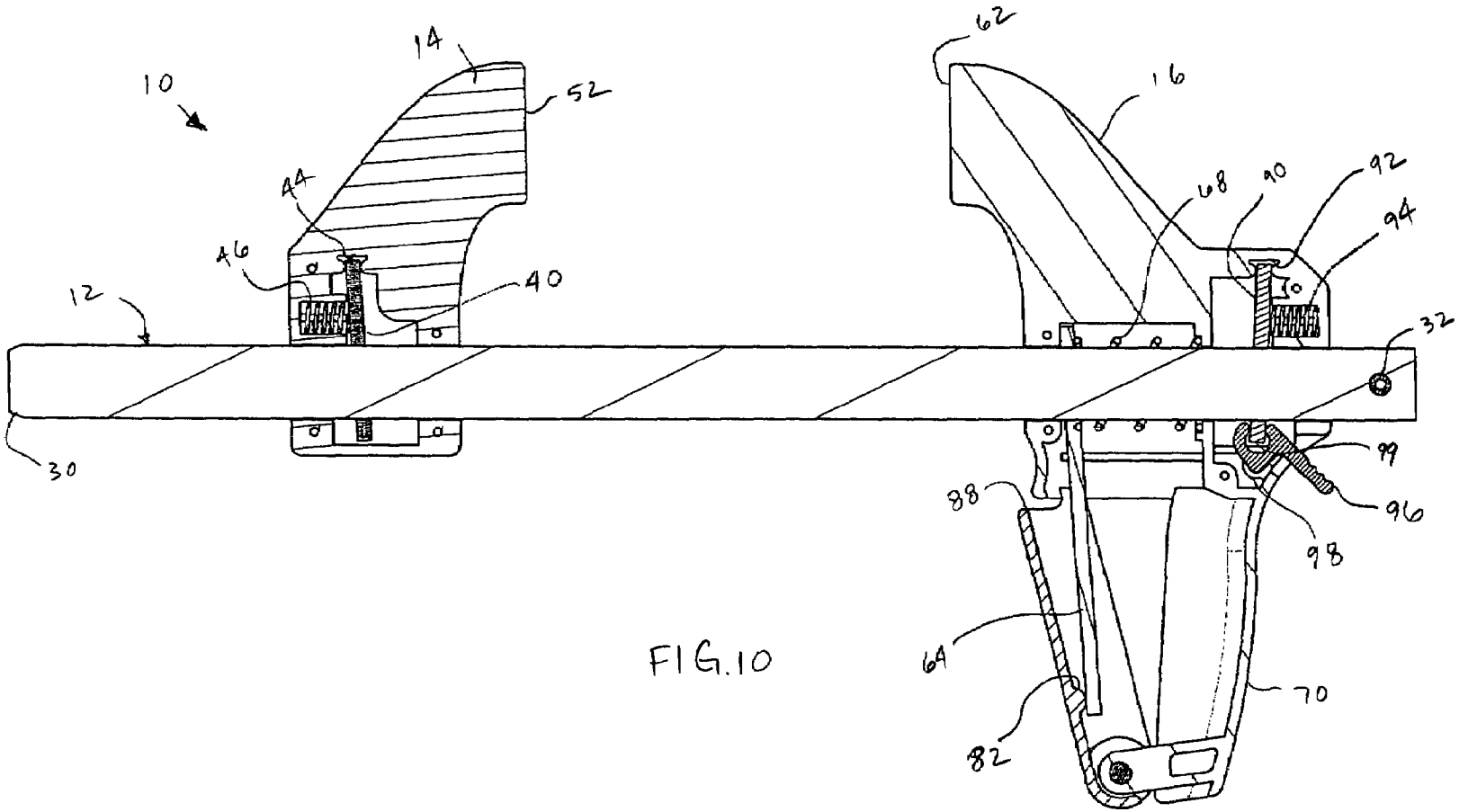
FIG. 10 is a longitudinal, side elevational cross-sectional view of the adjustable clamp of FIG. 1.

FIG. 9 shows yet another embodiment of the invention. FIG. 9 shows an adjustable clamp 210 that is substantially identical to clamp 110 disclosed above in FIGS. 6-8 except that clamp 210 does not use fixed jaw 16. Instead, clamp 210 uses a mechanical motor unit 216 that does not have a clamping surface. That is, mechanical motor unit 216 is substantially identical to fixed jaw 16 except that mechanical motor unit 216 does not have the clamping surface 62 that projects from the housing 60 of fixed jaw 16. Instead, the housing 260 has no projections. The mechanical motor unit 216 may be employed as a force applying mechanism for moving jaws such as 14 and 114 and can be use to clamp numerous devices that are being clamped with, for example, two moving jaws as seen in FIG. 8.

Additionally, the ability to remove the fixed jaw 16 or the motor unit 216 in addition to the moving jaws 14 and 114 permit different length bars to be employed with the same clamping devices, such as, 14, 114, and 16. Thus, a user can have one set of clamping devices (jaws/motor units), such as 14 and 16 or 14, 114, and 16, and bars of different lengths for different applications. This concept of using different length bars is equally applicable in all of the embodiments disclosed herein.

Figure 11:
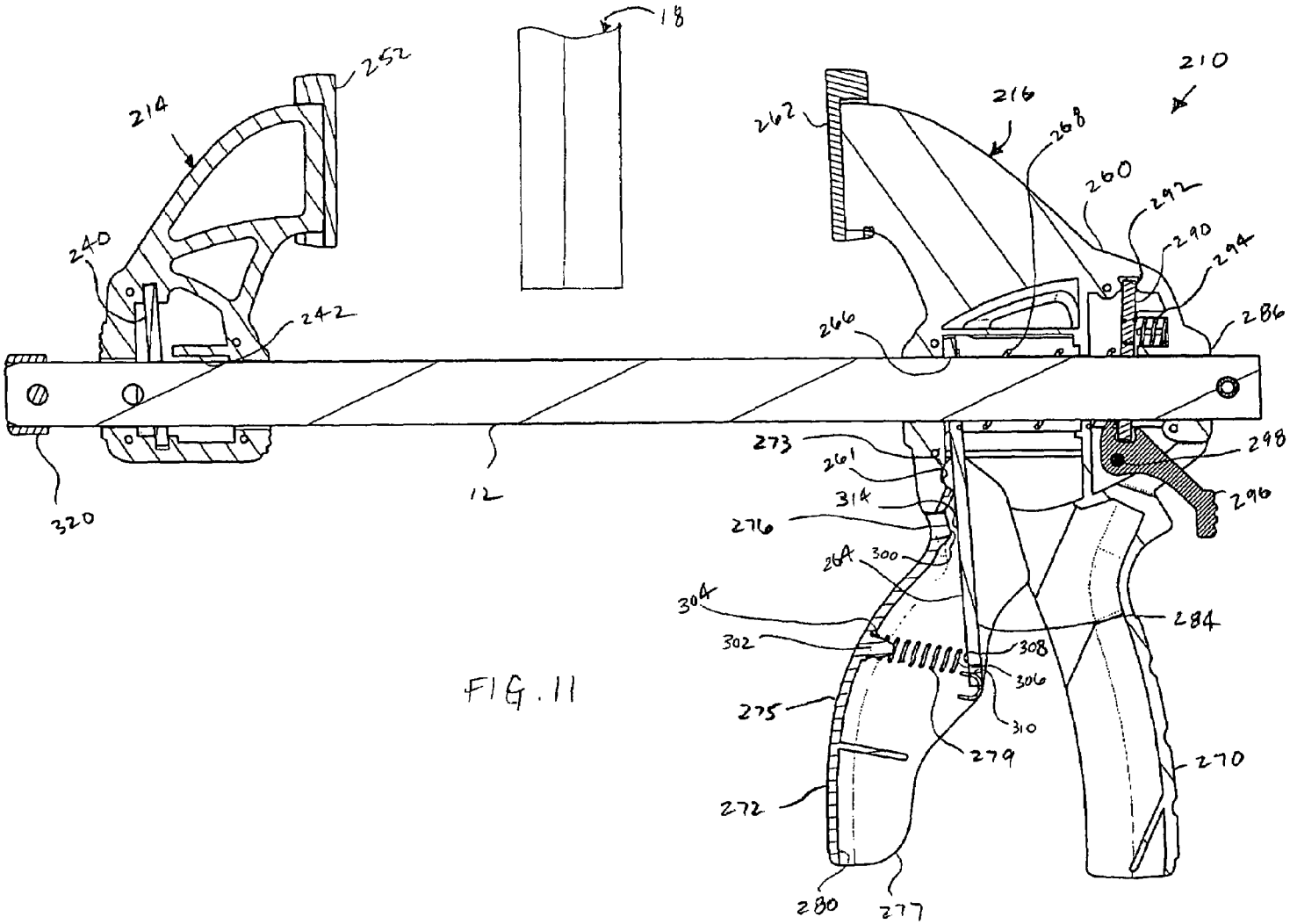
FIG. 11 illustrates an adjustable clamp in accordance with yet another embodiment of the invention.
Figure 12:
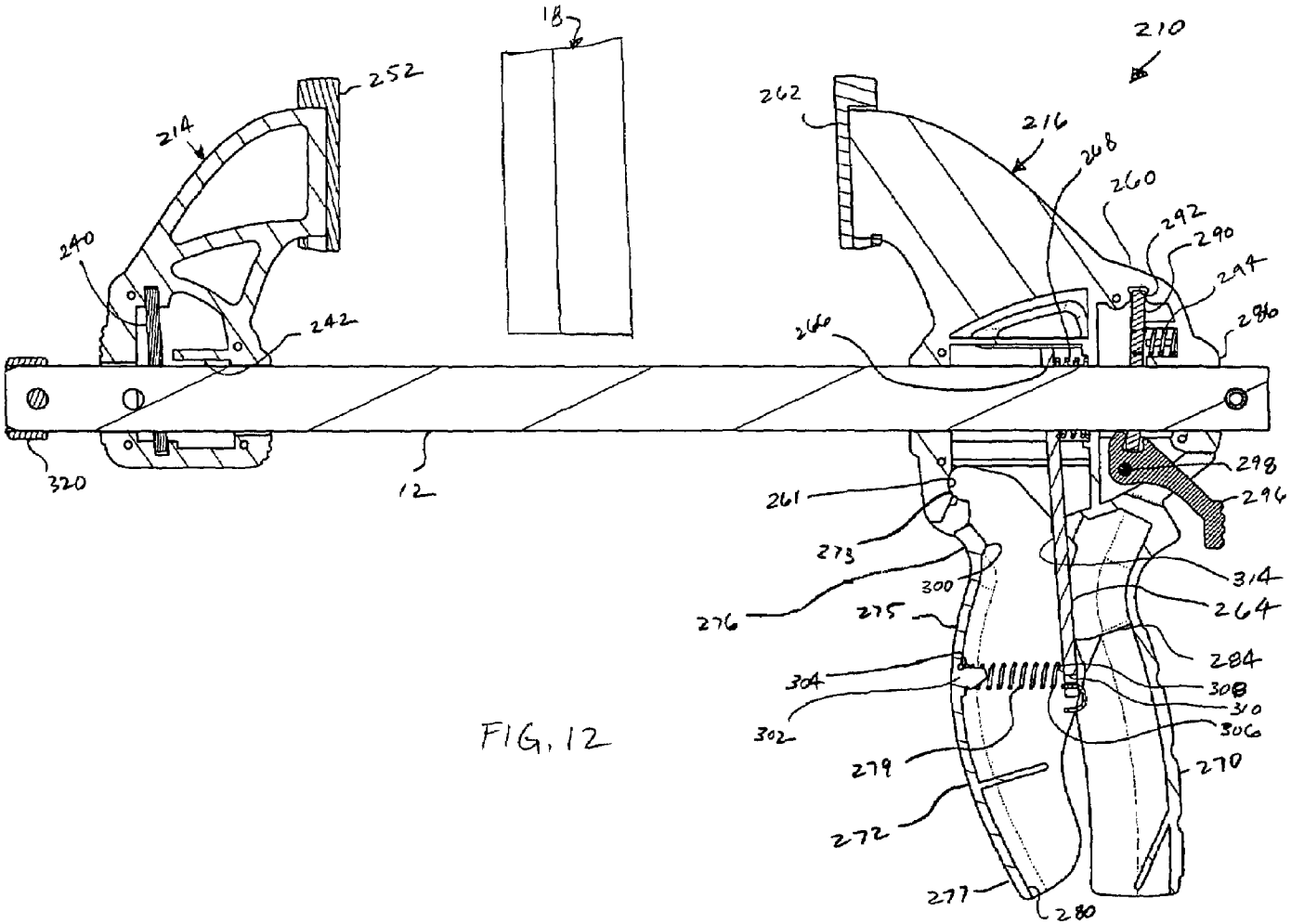
FIG. 12 illustrates the adjustable clamp of FIG. 11 utilizing a low mechanical advantage.
Figure 13:
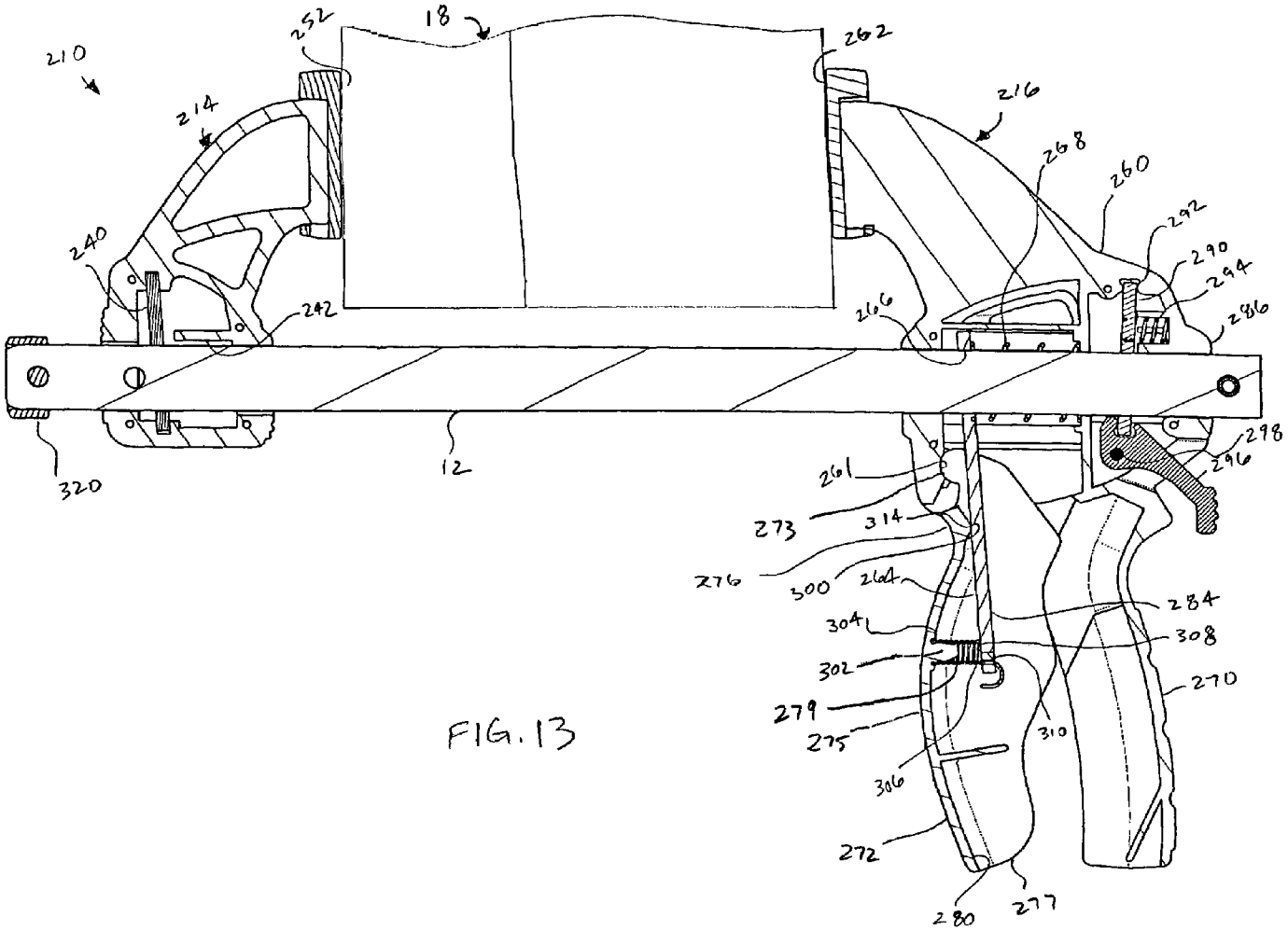
FIG. 13 illustrates the adjustable clamp of FIG. 11 utilizing a high mechanical advantage.

FIGS. 11-13 illustrate an adjustable clamp 210 in accordance with another embodiment of the invention. Clamp 210 has many elements that are substantially identical to clamp 10 described above and those elements are shown in FIGS. 11-13 with the use of reference numbers similar to those identified above with respect to clamp 10.

Clamp 210 includes the bar 12, a moving jaw 214, and a fixed jaw 216. In one embodiment, clamp 210 may be used by positioning jaws 214 and 216 on opposite sides of a member 18 to be clamped. The fixed jaw 216 is then activated to pull the bar 12 through the fixed jaw 216, thus bringing moving jaw 214 closer to fixed jaw 216. The fixed jaw 216 may be automatically activated so that the fixed jaw 216 may move the bar 12 rapidly and easily through the fixed jaw 216 prior to the clamping of the member 18 and then, once the clamping on member 18 beings, the activation of fixed jaw 216 may advance the bar 12 through the fixed jaw 216 at a slower rate but with a higher mechanical advantage so that greater force can be applied in the easiest manner for the user applying the pressure to the fixed jaw 216 by hand.

Although the moving jaw 214 may be any of the various moving-type jaws known in the prior art, moving jaw 214 is illustrated as having a braking lever 240 that permits the bar 12 to pass through moving jaw housing 242. The braking lever 240 is positioned and sufficiently movable within the moving jaw housing 242 such that the moving jaw 214 is movable only in one direction with respect to bar 12. As illustrated in FIGS. 11-13, the braking lever 240 is positioned so that the moving jaw 214 may be moved relative to bar 12 in a direction away from the fixed jaw 216, but moving jaw 214 cannot be moved relative to bar 12 in a direction toward fixed jaw 216. The moving jaw 214 may be moved to a selected position on the bar 12 and then be clamped against member 18 upon activation of the fixed jaw 216. The moving jaw 214 has a clamping face 252 for engaging member 18. Of course, the moving jaw 14 described with respect to clamp 10 above, or other appropriate moving jaws, may be employed in clamp 210 in place of or in addition to moving jaw 214. As described herein, the moving jaw 214 and the fixed jaws may also be removed from the bar 12 and used as described above.

Fixed jaw 216, as illustrated in FIGS. 11-13, has a main section that is structured and arranged to permit the bar 12 to pass therethrough. As illustrated, the main section comprises a housing 260 having an opening extending completely therethrough for the passage of bar 12. The fixed jaw 216 also has a clamping face 262 extending from the housing 260. A drive lever 264 is positioned within the housing 260 and is structured and arranged to couple the bar 12. That is, the illustrated drive lever 264 has an opening 266 extending therethrough for the passage of bar 12. The drive lever 264 is movable within the housing 260 and may be maintained within its area of movement within the housing 260 by housing 260 itself. Drive lever 264 is biased by a resilient element, such as a spring 268 in a direction away from handle 270, which extends from housing 260 for grasping by a user.

A trigger 272 is pivoted to the main section housing 260. The trigger 272 may pivot, for example, about a rounded lug 273 extending from a main body portion 275 of the trigger. The lug 273 may pivot and be secured within a recess 261 in housing 260 of the main section that has a complementary shape, which substantially mirrors the shape of the lug 273. As illustrated in FIGS. 11-13, trigger 272 is pivoted to the housing 260 toward an upper section 276 of the trigger 272. The lower section 277 of the trigger 272 remains unattached and moves corresponding to the pivoting of the trigger 272.

The trigger 272 may be hollow with three sides while open in the side facing handle 270. The trigger is shown in the nonactuated position in FIG. 11. When the trigger 272 is in the nonactuated position, the trigger 272 is biased to pivot away from the handle 270 by the force of biasing spring 268 against the drive lever 264 and the force of biasing spring 279, which is positioned between the drive lever 264 and the inner contact surface 280 of the trigger 272. Although various apparatus may be employed to provide the connection between the trigger 272 and the drive lever 264, the connection may be made by a resilient member as illustrated and described herein. For example, as illustrated in FIGS. 11-13, the connection includes a projection 302 that extends from the inner contact surface 280 to support one end 304 of compression spring 279. The other end 306 of spring 279 may be securely attached to drive lever 264 at a point 308 on drive lever 264 that is remote from the bar 12. In the illustrated embodiment, the end 306 of spring 279 may be inserted through an opening 310 in drive lever 264 to complete the connection. Thus, in the nonactuated position of FIG. 11, the trigger 272 is biased away from the handle 270 by the force of the compression spring 279, while the drive lever 264 is biased away from the handle 270 by spring 268. Meanwhile, an upper end of the trigger 272 includes an upper force applying member 300 for applying a high mechanical advantage as described below.

The interconnection between the bar 12 and the drive lever 264 is substantially identical to the relationship between bar 12 and drive lever 64 described above. Since the size of the opening 266 in drive lever 264 is slightly larger than the width of the bar 12, when the angle of bar 12 is inclined with respect to a line parallel to the longitudinal axis 50 of the bar 12, a tight, slip-free fit is created between the bar 12 and the drive lever 264 so that when the drive lever 264 is moved, the bar 12 moves along with the drive lever 264.

FIGS. 11-13 illustrate the pivoting of trigger 272 and the changing of the contact point between the trigger 272 and the drive lever 264. In FIG. 11, the trigger 272 is in the nonactuated position as biased by springs 268 and 279. The trigger 272 contacts the driving lever 264 via spring 279 at the initial contact point 308, which is at the remote end 284 of drive lever 264 from the bar 12. Therefore, when the trigger 272 initially is pulled by a hand of the user and pivots about lug 273 toward the handle 270 out of the nonactuated position, the contact point 308 between the trigger 272 and the drive lever 64 is such that a low mechanical advantage is produced for forcing the drive lever 264 to move the bar 12 toward the rear end 286 of housing 260. This movement produces a relatively large displacement of the bar 12 through the housing 260 as a relatively light force is applied by the user on the trigger 272 at the remote point 308. Generally, the use of only the low mechanical advantage will be employed prior to the clamp's 210 engagement with clamped members 18. Thus, at this time, the force necessary to move the bar 12 relative to the housing 260 is generally a force that is able to move merely the bar 12 and the moving jaw 214. Therefore, the spring 279 or other resilient member may be designed so that it will not compress to undesired levels while acting against the force of the bar 12 and moving jaw 214 to move the bar 12 relative to the housing, prior to the jaws 214 and 216 engaging the members 18, as illustrated in FIG. 12. In other words, during low force applications, the spring 279 is designed to provide a sufficient force against the drive lever 264 to move the drive lever 264 while a user pulls on the trigger 272 while keeping the drive lever 264 from engaging the upper force applying mechanism 300 of the trigger 272, which produces a high mechanical advantage with smaller, incremental movements of the bar 12 relative to the housing 260.

When the clamp 210 requires greater force than that for which the spring 279 is designed, the upper force applying mechanism 300 of the trigger 272 provides a high mechanical advantage. The mechanism 300 extends as a projection from the inner contact surface 280 toward the handle and provides a point of contact with drive lever 264 at a point 314 on drive lever 264 that is closer to the bar 12 than the point 308. The projection 300 may directly contact drive lever 264 and provide a greater application of force to the drive lever 264 to move the bar 12 relative to the housing 260 when more force is needed. For example, as illustrated in FIG. 13, when the jaws 214 and 216 are engaged with the members 18 and a tight connection between the members 18 is desired, as greater force is applied by the jaws 214 and 216 and that force overcomes the force applied by spring 279. When this happens, the spring 279 compresses and permits contact between the drive lever 264 and the projection 300 as illustrated in FIG. 13. Then, as the trigger 272 is pulled further toward the handle 260 a higher mechanical advantage and larger force are applied to bar 12 to move the bar 12 relative to housing 260 and to increase the force applied by the jaws 214 and 216. The shape of the trigger 272 may be configured to increase the mechanical advantage applied by the projection 300. For example, as illustrated in FIG. 13, the mechanical advantage of the projection 300 is increased by the downward and curved shaping of the trigger 272 and its primary gripping area.

Therefore, if, for example, the fixed jaw 216 is not in contact with the member 18 a user can quickly and easily pull the trigger 272 to its fullest extent and rapidly repeat the full trigger pulls to quickly and easily move the drive lever 264 and the bar 12 toward the rear 286 of housing 260 since the contact point 308 is being moved by the resilient member, spring 279. Then, when, for example, the jaws 214 and 216, are in contact with the member 18 and it is desired to clamp the member 16 with a larger force requiring little movement of the bar 12, the force required to move the drive lever 264 increases to the extent that as the trigger 272 is moved toward the handle 270, the spring 279 compresses and permits the projection 300 to contact the drive lever 264. Thus, the projection 300 now provides the force necessary to move the drive lever 264 and bar 12 and to increase the force applied by the jaws 214 and 216 on members 18.

Although, the illustrated embodiment only shows two contact points 308 and 314, the contact surface 280 of trigger 272 may be designed so that there are any number of contact points between the trigger 272 and the drive lever 264 to provide various levels of mechanical advantage.

When it is desired to release the clamping force and the bar 12, fixed jaw 216 includes a breaking lever 290 that permits the bar 12 to pass therethrough. The braking lever 290 is pivoted within the housing 260 within a groove 292 and is biased by a resilient element, such as a spring 294. The operation of the braking lever 290 is substantially identical to the operation of braking lever 90 described above.

The clamp 210 includes a removable end stop 320 that may be removed to permit the jaws 214 and 216 to be removed from bar 12 and used in the variety of ways described above with respect to the other embodiments of the invention disclosed therein, including, but not limited to, use as a spreader and the use of two movable jaws 214.

The foregoing embodiments have been provided to illustrate the structural and functional principles of the present invention, and are not intended to be limiting. To the contrary, the present invention is intended to encompass all modifications, alterations, and substitutions within the scope of the appended claims.

What is claimed is:

1. A jaw for a bar clamp, comprising:

a main section structured and arranged to permit a bar to pass-through;

a clamping face extending from said main section;

a drive lever structured and arranged to couple the bar;

a handle extending from said main section; and a trigger pivoted to said main section, said trigger having a first force applying mechanism structured and arranged to apply a first force against said drive lever at a first point on said drive lever that is remote from the bar as said trigger pivots with respect to said main section to provide low mechanical advantage to said drive lever, said trigger having a second force applying mechanism structured and arranged to apply a second force against said drive lever at a second point on said drive lever that is closer to the bar than said first point as said trigger pivots with respect to said main section to provide high mechanical advantage to said drive lever, wherein the first force applying mechanism is structured and arranged such that, as the trigger is pivoted away from its nonactuated position, the first force applying mechanism applies the first force against the drive lever before the second force applying mechanism applies the second force against the drive lever.

2. A jaw according to claim 1, wherein said main section is a housing with two opposite openings to permit the bar to pass through.

3. A jaw according to claim 1, wherein said drive lever has an aperture for the bar to pass through.

4. A jaw according to claim 1, wherein said drive lever is biased toward said trigger by a resilient element.

5. A jaw according to claim 4, wherein said housing has a resiliently biased bar breaking lever coupled to a release lever.

6. A jaw according to claim 1, wherein said first force applying mechanism is a resilient member that is operatively positioned such that the first force is transferred to the drive lever via the resilient member.

7. A jaw according to claim 6, wherein said resilient member is a spring.

8. A jaw according to claim 6, wherein said trigger has a body portion and said resilient member is fastened to said body portion and to said drive lever.

9. A jaw according to claim 1, wherein said second force applying mechanism is an projection that extends toward said drive lever.

10. A jaw according to claim 1, wherein said second force applying mechanism is structured and arranged to be spaced from said drive lever when said trigger is in a nonactuated position.

11. A jaw according to claim 1, wherein said first force applying mechanism is structured and arranged to apply said first force against said drive lever while said second force applying mechanism applies said second force against said drive lever.

12. A jaw for a bar clamp, comprising:

a main section structured and arranged to permit a bar to pass-through;

a clamping face extending from said main section;

a drive lever structured and arranged to couple the bar;

a handle extending from said main section; and a trigger pivoted to said main section, said trigger having a resilient member coupled to said drive lever to apply a first force against said drive lever at a first point on said drive lever that is remote from the bar as said trigger pivots with respect to said main section to provide low mechanical advantage to said drive lever, said trigger having a second force applying mechanism structured and arranged to apply a second force against said drive lever at a second point on said drive lever that is closer to the bar than said first point as said trigger pivots with respect to said main section to provide high mechanical advantage to said drive lever, said resilient member being structured and arranged to apply said first force against said drive lever in an extended position, wherein the trigger is structured and arranged such that, as the trigger is pivoted away from its nonactuated position, the resilient member applies the first force against the drive lever before the second force applying mechanism applies the second force against the drive lever.

13. A jaw according to claim 12, wherein said resilient member is a spring.

14. A jaw according to claim 12, wherein said second force applying mechanism is an projection that extends toward said drive lever.

15. A jaw according to claim 12, wherein said trigger has a body portion and said resilient member is fastened to said body portion and to said drive lever.

16. A jaw according to claim 12, wherein said second force applying mechanism is structured and arranged to be spaced from said drive lever when said trigger is in a nonactuated position.

17. A jaw for a bar clamp, comprising:

a main section structured and arranged to permit a bar to pass-through;

a clamping face extending from said main section;

a drive lever structured and arranged to couple the bar;

a handle extending from said main section; and a trigger pivoted to said main section, said trigger having a first force applying mechanism structured and arranged to apply a first force against said drive lever as said trigger pivots with respect to said main section, and a second force applying mechanism structured and arranged to apply a second force against said drive lever as said trigger pivots with respect to said main section, wherein said first force applying mechanism is structured and arranged to provide a lower mechanical advantage to said drive lever than said second force applying mechanism is structured and arranged to provide, and wherein the first force applying mechanism is structured and arranged to apply said first force against said drive lever before said second force applying mechanism applies said second force against said drive lever as the trigger is pivoted away from its nonactuated position.

18. A method of using a bar clamp, comprising:

positioning a first jaw on a first bar clamp, the first jaw being selectively securable on the first bar;

positioning a second jaw with a mechanical motor unit on the first bar, the second jaw having a main section structured and arranged to permit the first bar to move the first jaw relative to the second jaw, a clamping face extending from the main section, a drive lever that couples the first bar, a handle extending from the main section, and a trigger pivoted to the main section; and activating the mechanical motor unit to move the first bar and to force the first jaw toward the second jaw, the activating of the mechanical motor unit occurring by pulling the trigger towards the handle to apply a first force against the drive lever at a first point on the drive lever that is remote from the bar as the trigger pivots with respect to the main section to provide low mechanical advantage to the drive lever, and further pulling the trigger toward the handle to apply a second force against the drive lever at a second point on the drive lever that is closer to the bar than the first contact point as the trigger pivots with respect to the main section to provide high mechanical advantage to the drive lever, wherein the first force is applied against the drive lever before the second force.

19. A method of claim 18, further comprising:

removing the first jaw and the second jaw from the first bar; and positioning the first jaw and the second jaw on a second bar, which has a length that is different than the length of the first bar.

20. A method of claim 18, wherein the first force is applied against the drive lever while the second force is applied against the drive lever.

* * * * *

UNITED STATES PATENT AND TRADEMARK OFFICE

CERTIFICATE OF CORRECTION

PATENT NO. : 7,389,978 B2
APPLICATION NO. : 11/363081
DATED : June 24, 2008
INVENTOR(S) : Stephen Rowlay, Keith M. Lombardi and Alisdair Cumming It is certified that error appears in the above-identified patent and that said Letters Patent is hereby corrected as shown below:

Title Page, Column 1, please add the following priority claim:

--Related U.S. Application Data

(63) Continuation-in-part of application No. 11/236,566, filed on Sep. 28, 2005, now Pat. No. 7,090,209--.

Signed and Sealed this

Seventeenth Day of August, 2010

David J. Kappos

David J. Kappos
*Director of the United States Patent and Trademark Office*